US009497560B2

(12) United States Patent
Tanaka

(10) Patent No.: US 9,497,560 B2
(45) Date of Patent: Nov. 15, 2016

(54) AUDIO REPRODUCING APPARATUS AND METHOD

(71) Applicant: PANASONIC INTELLECTUAL PROPERTY MANAGEMENT CO., LTD., Osaka (JP)

(72) Inventor: Naoya Tanaka, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/774,126

(22) PCT Filed: Jan. 30, 2014

(86) PCT No.: PCT/JP2014/000491

§ 371 (c)(1),
(2) Date: Sep. 9, 2015

(87) PCT Pub. No.: WO2014/141577

PCT Pub. Date: Sep. 18, 2014

(65) Prior Publication Data

US 2016/0044435 A1 Feb. 11, 2016

(30) Foreign Application Priority Data

Mar. 13, 2013 (JP) ..... 2013-050024

(51) Int. Cl.
*H04R 3/02* (2006.01)
*H04S 7/00* (2006.01)
(Continued)

(52) U.S. Cl.
CPC . *H04S 7/30* (2013.01); *H04R 5/02* (2013.01); *H04S 1/00* (2013.01)

(58) Field of Classification Search
CPC ..... H04S 1/00; H04S 7/30; H04R 5/02
USPC ..... 381/303, 307, 310, 300, 17, 1, 18, 20, 381/22
See application file for complete search history.

(56) References Cited

U.S. PATENT DOCUMENTS 4,024,344 A 5/1977 Dolby et al.
4,841,573 A 6/1989 Fujita
(Continued)

FOREIGN PATENT DOCUMENTS

JP 51-072402 A 6/1976
JP 64-060200 A 3/1989
(Continued)

OTHER PUBLICATIONS

International Search Report and Written Opinion issued in corresponding International Patent Application No. PCT/JP2014/000491, mailed on Feb. 25, 2014; 9 page with English translation.

*Primary Examiner* — Melur Ramakrishnaiah
(74) *Attorney, Agent, or Firm* — McDermott Will & Emery LLP

(57) ABSTRACT

An audio reproducing apparatus includes: an obtainment unit configured to obtain a stereo audio signal including an L channel signal and an R channel signal; and a control unit configured to (i) generate a first audio signal for a speaker disposed at an upper position in a listening space and a second audio signal for a speaker disposed at a lower position in the listening space, using the L channel signal and the R channel signal and (ii) determine a gain coefficient corresponding to a degree of correlation between the L channel signal and the R channel signal and multiply by the determined gain coefficient at least one of the first audio signal and the second audio signal, to approximate a ratio between energy of sound reproduced from the first audio signal and energy of sound reproduced from the second audio signal to a predetermined value.

6 Claims, 7 Drawing Sheets

(51) Int. Cl.
*H04S 1/00* (2006.01)
*H04R 5/02* (2006.01)

(56) References Cited

U.S. PATENT DOCUMENTS

| | | | | |
|---|---|---|---|---|
| 5,740,253 | A * | 4/1998 | Takeuchi | H04S 1/002 381/1 |
| 9,088,844 | B2 | 7/2015 | Ohashi | |
| 2005/0069148 | A1 | 3/2005 | Nishikawa et al. | |
| 2008/0049943 | A1 | 2/2008 | Faller et al. | |
| 2008/0165286 | A1 | 7/2008 | Oh et al. | |
| 2008/0165975 | A1 | 7/2008 | Oh et al. | |
| 2008/0167864 | A1 | 7/2008 | Faller et al. | |
| 2008/0192941 | A1 | 8/2008 | Oh et al. | |
| 2008/0199026 | A1 | 8/2008 | Oh et al. | |
| 2008/0205657 | A1 | 8/2008 | Oh et al. | |
| 2008/0205670 | A1 | 8/2008 | Oh et al. | |
| 2008/0205671 | A1 | 8/2008 | Oh et al. | |
| 2008/0269929 | A1 | 10/2008 | Oh et al. | |
| 2009/0171676 | A1 | 7/2009 | Oh et al. | |
| 2009/0281814 | A1 | 11/2009 | Oh et al. | |
| 2010/0010818 | A1 | 1/2010 | Oh et al. | |
| 2010/0010819 | A1 | 1/2010 | Oh et al. | |
| 2010/0010820 | A1 | 1/2010 | Oh et al. | |
| 2010/0010821 | A1 | 1/2010 | Oh et al. | |
| 2010/0014680 | A1 | 1/2010 | Oh et al. | |
| 2010/0040135 | A1 | 2/2010 | Yoon et al. | |
| 2010/0092008 | A1 | 4/2010 | Oh et al. | |
| 2010/0106270 | A1 | 4/2010 | Oh et al. | |
| 2010/0119073 | A1 | 5/2010 | Oh et al. | |
| 2010/0121470 | A1 | 5/2010 | Oh et al. | |
| 2010/0145487 | A1 | 6/2010 | Oh et al. | |
| 2010/0145711 | A1 | 6/2010 | Oh et al. | |
| 2010/0189266 | A1 | 7/2010 | Oh et al. | |
| 2010/0191354 | A1 | 7/2010 | Oh et al. | |
| 2010/0241438 | A1 | 9/2010 | Oh et al. | |
| 2010/0250259 | A1 | 9/2010 | Oh et al. | |
| 2011/0040567 | A1 | 2/2011 | Oh et al. | |
| 2011/0268299 | A1* | 11/2011 | Oda | H04R 5/04 381/307 |
| 2012/0140598 | A1 | 6/2012 | Wakabayashi | |
| 2012/0250869 | A1 | 10/2012 | Ohashi | |

FOREIGN PATENT DOCUMENTS

| | | | |
|---|---|---|---|
| JP | 2004-168265 | A | 6/2004 |
| JP | 2005-051324 | A | 2/2005 |
| JP | 2010-515290 | A | 5/2010 |
| JP | 2011-151633 | A | 8/2011 |
| JP | 2012-120052 | A | 6/2012 |
| JP | 2012-120133 | A | 6/2012 |
| JP | 2012-212982 | A | 11/2012 |
| WO | 2008/032209 | A2 | 3/2008 |

* cited by examiner

AUDIO REPRODUCING APPARATUS AND METHOD

RELATED APPLICATIONS

This application is the U.S. National Phase under 35 U.S.C. §371 of International Patent Application No. PCT/JP2014/000491, filed on Jan. 30, 2014, which in turn claims the benefit of Japanese Application No. 2013-050024, filed on Mar. 13, 2013, the disclosures of which Applications are incorporated by reference herein.

TECHNICAL FIELD

The present disclosure relates to an audio reproducing apparatus, and in particular to an audio reproducing apparatus that reproduces an audio signal from both above and below a viewer to form a diffuse sound field.

BACKGROUND ART

Patent Literature (hereinafter abbreviated as "PTL") 1 discloses an audio apparatus (speaker apparatus). This audio apparatus includes a first speaker and a second speaker that are vertically distant from each other in a car passenger compartment, and a driving control unit that causes the first speaker and the second speaker to output sound. The driving control unit delays the sound output from one of the first speaker and the second speaker that is closer to the listener, by a predetermined time period.

This increases the spatial impression of sound, and can produce a sound image felt by the listener at a higher position.

CITATION LIST

Patent Literature

[PTL 1] Unexamined Patent Application Publication No. 2005-051324

SUMMARY OF INVENTION

Technical Problem

The present disclosure provides an audio reproducing apparatus that can suppress change in distribution of the diffuse sound field when speakers disposed at an upper position and a lower position in a room output sound reproduced from signals that are generated from a stereo audio signal.

Solution to Problem

The audio reproducing apparatus according to the present disclosure includes: an obtainment unit configured to obtain a stereo audio signal including an L channel signal and an R channel signal; and a control unit configured to (i) generate a first audio signal for a speaker disposed at an upper position in a listening space and a second audio signal for a speaker disposed at a lower position in the listening space, using the L channel signal and the R channel signal and (ii) determine a gain coefficient corresponding to a degree of correlation between the L channel signal and the R channel signal and multiply by the determined gain coefficient at least one of the first audio signal and the second audio signal, to approximate a ratio between energy of sound reproduced from the first audio signal and energy of sound reproduced from the second audio signal to a predetermined value, wherein the control unit is configured to generate at least one of the first audio signal and the second audio signal by combining the L channel signal and the R channel signal.

Advantageous Effects of Invention

The audio reproducing apparatus according to the present disclosure can suppress change in distribution of the diffuse sound field when speakers disposed at an upper position and a lower position in a room output sound reproduced from signals that are generated from a stereo audio signal.

DESCRIPTION OF EMBODIMENTS (Underlying Knowledge Forming Basis of the Present Disclosure)

Figure 1:
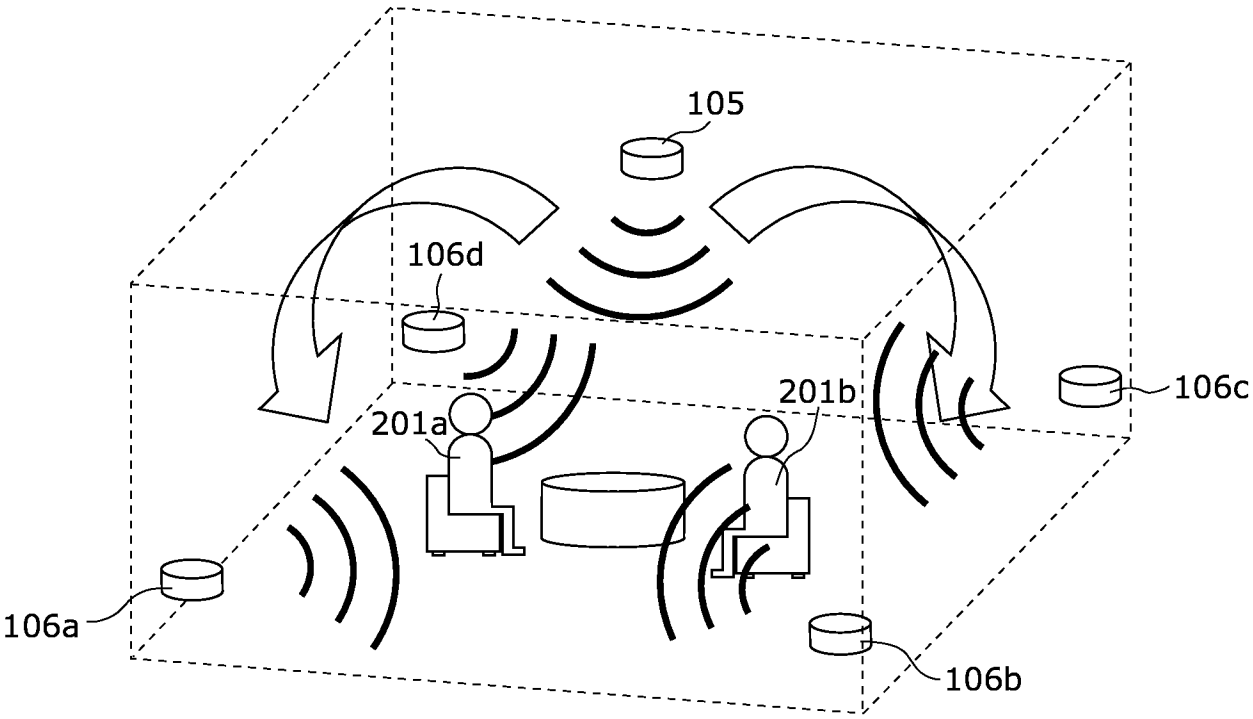
FIG. 1 illustrates a structure of a listening space in which a speaker is disposed at an upper position.

Conventionally, speakers that can be placed on a ceiling are known, such as speakers with light (illumination). By placing the speakers on a ceiling, sound can be output from above a room. FIG. 1 illustrates a structure of a listening space in which a speaker is disposed at an upper position.

In the listening space of FIG. 1, lower speakers 106*a* to 106*d* are disposed around listeners 201*a* and 201*b* (lower position in the listening space). Furthermore, an upper speaker 105 is disposed above the listeners 201*a* and 201*b* (higher position in the listening space).

In the listening space with such a structure, a sound field that surrounds the listeners 201*a* and 201*b* can be formed.

Figure 2:
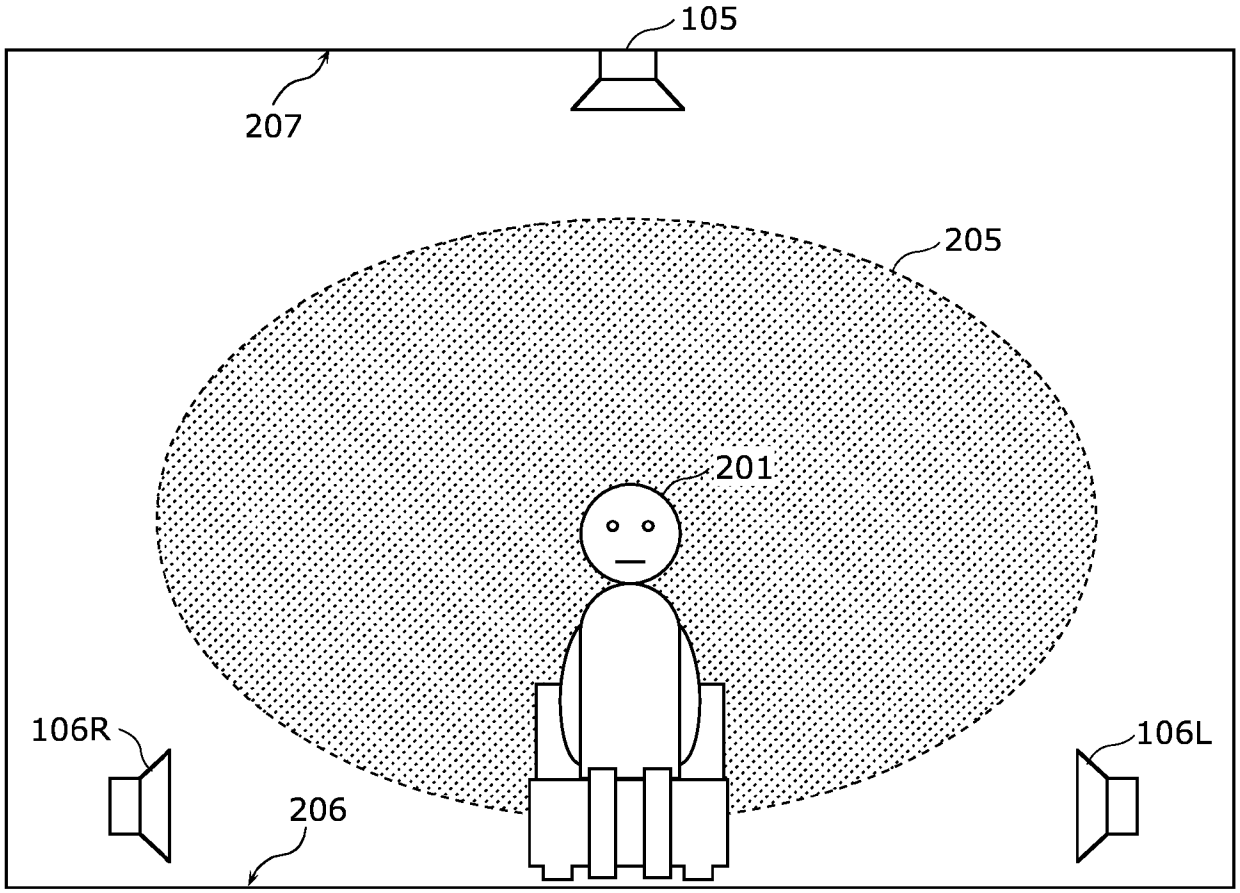
FIG. 2 illustrates a simple structure of the listening space with an upper speaker.

Here, the listening space with the upper speaker 105 can be simply structured as illustrated in FIG. 2. FIG. 2 illustrates the simple structure of the listening space with the upper speaker 105.

In the listening space in FIG. 2, the upper speaker 105 is disposed on a ceiling 207 in a room. Furthermore, an L channel speaker 106L and an R channel speaker 106R are placed on a floor surface 206 of the room.

In a typical structure, sound reproduced from a stereo audio signal, that is, an L channel signal and an R channel signal are output from the L channel speaker 106L and the R channel speaker 106R, respectively. Furthermore, sound reproduced from a signal obtained by combining the L channel signal and the R channel signal is output from the upper speaker 105. Accordingly, a sound field 205 that surrounds a listener 201 can be formed. The sound field 205 in FIG. 2 visually represents a sound field formed by the sounds reproduced from the upper speaker 105, the L channel speaker 106L, and the R channel speaker 106R.

Figure 3:
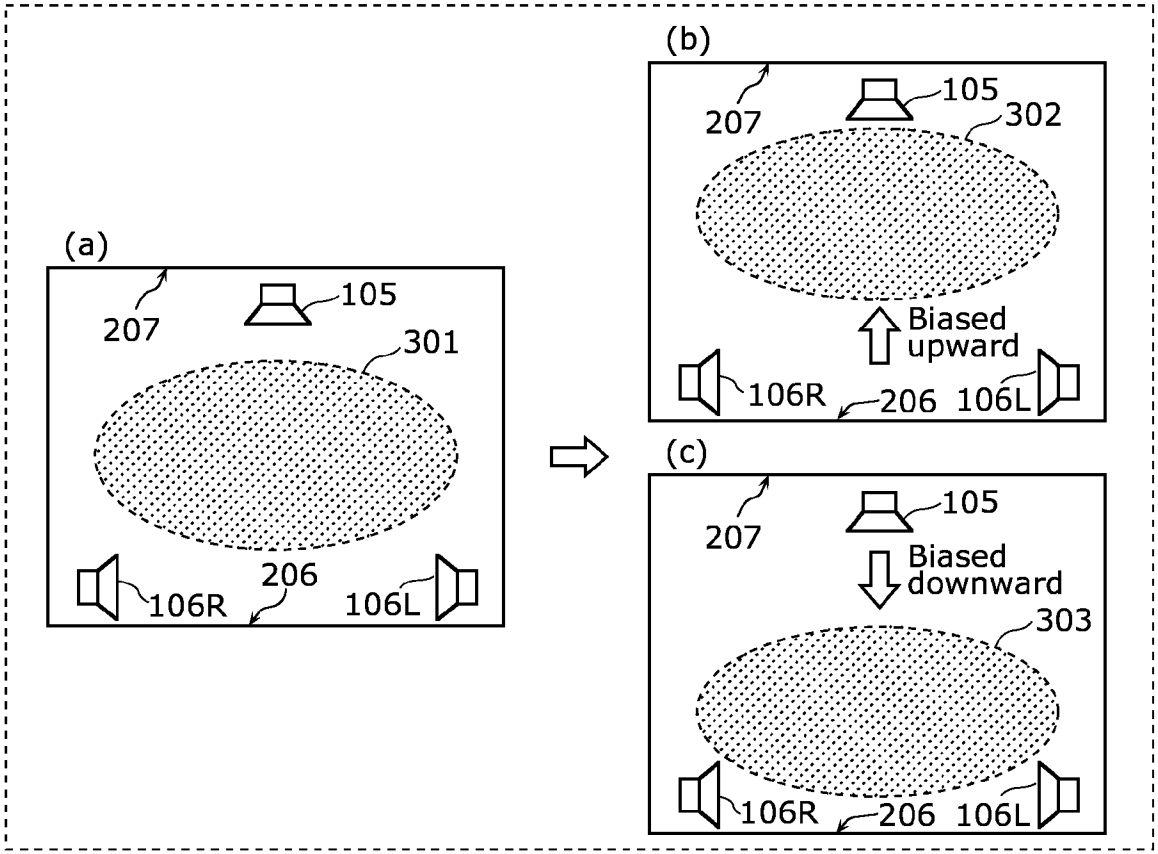
FIG. 3 illustrates a problem occurring in the listening space with the structure illustrated in FIG. 2.

In the listening space with such a structure, the Inventor has found the following problem. FIG. 3 illustrates the problem occurring in the listening space with the structure illustrated in FIG. 2.

In the listening space with the structure illustrated in FIG. 2, the sound field formed by the reproduced sounds is ideally located at a desired position as a sound field 301 in (a) of FIG. 3, without being biased upward or downward.

However, in the listening space in FIG. 2, distribution of the sound field varies while sound is reproduced. Specifically, the listener 201 feels very uncomfortable when a irregular phenomenon occurs, for example, when distribution of a sound field is biased upward as a sound field 302 in (b) of FIG. 3 and when distribution of a sound field is biased downward as a sound field 303 in (c) of FIG. 3.

A phenomenon similar to this phenomenon occurs in a structure in which all of the L channel speaker 106L, the R channel speaker 106R, and the upper speaker 105 are disposed at the same height to surround the listener 201 in FIG. 2.

However, when the speakers are disposed only around the listener 201, the distribution of the sound field varies in the longitudinal direction and the horizontal direction of the listener 201. Thus, the listener 201 feels less uncomfortable. Furthermore, techniques that actively apply the two-dimensional variations in a sound field are known, and bias of the sound field hardly poses a problem in a listening space excluding the upper speaker 105.

Thus, the present disclosure provides an audio reproducing apparatus that suppresses variations in distribution of a sound field that is significantly perceived by the listener 201 when speakers disposed at an upper position and a lower position in a room output sound reproduced from a stereo audio signal. The audio reproducing apparatus according to the present disclosure can provide a sound field that is stable and comfortable to the listener 201. Thus, the usability of the audio reproducing apparatus is very high.

Non-limiting Embodiments will be described in detail with reference to the drawings as appropriate. The unnecessary details may be omitted. For example, description of known details and overlapping description of the substantially identical configuration may be omitted. This prevents the following description to be unnecessarily redundant, and facilitates better understanding of a person skilled in the art.

The inventors provide the drawings and the description so that the person skilled in the art fully understands the present disclosure, but do not intend to limit the scope of the claims. Furthermore, the drawings are schematic, not necessarily exact.

Embodiment 1

Figure 4:
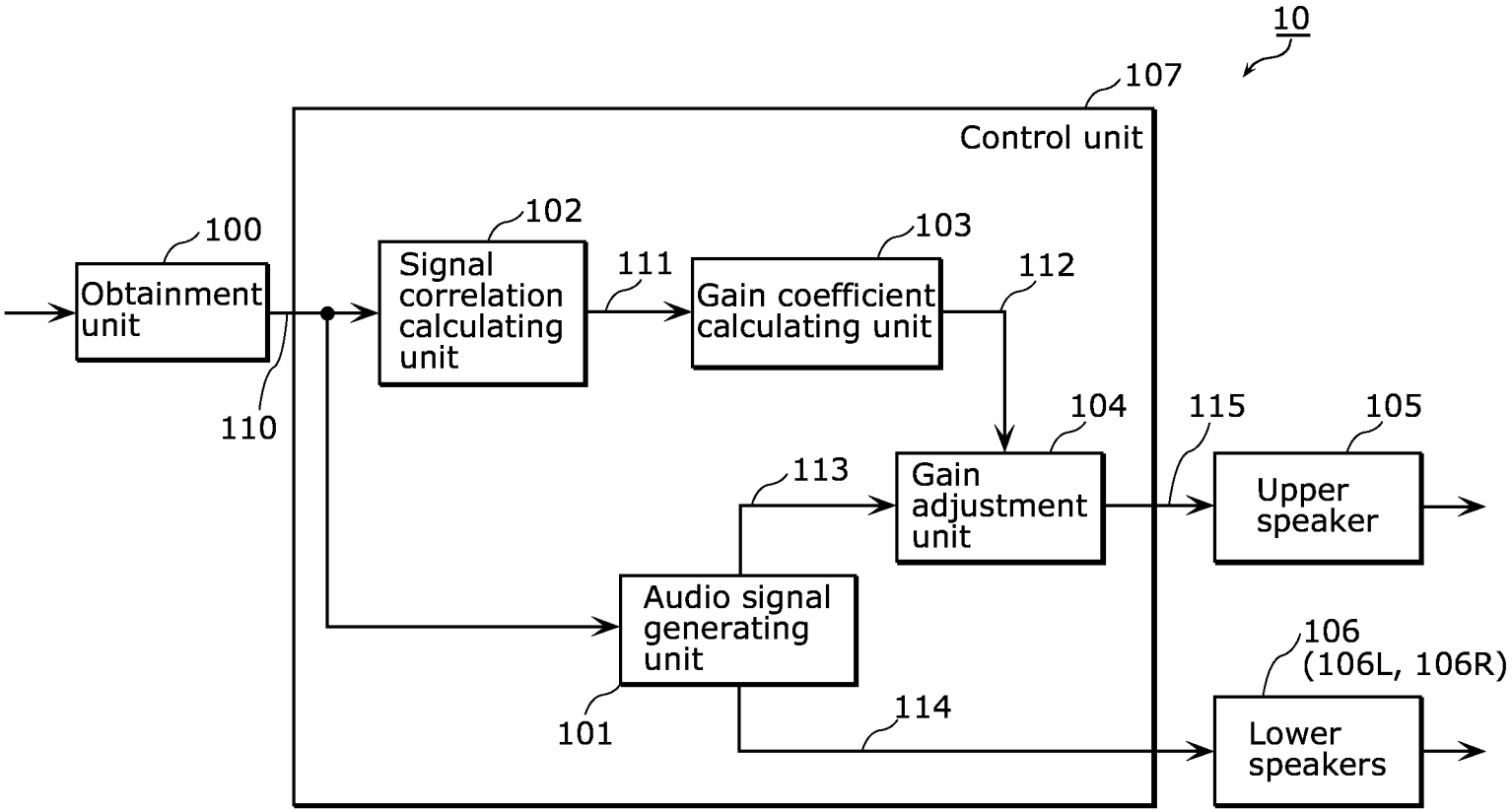
FIG. 4 is a block diagram illustrating a functional configuration of an audio reproducing apparatus according to Embodiment 1.
Figure 5:
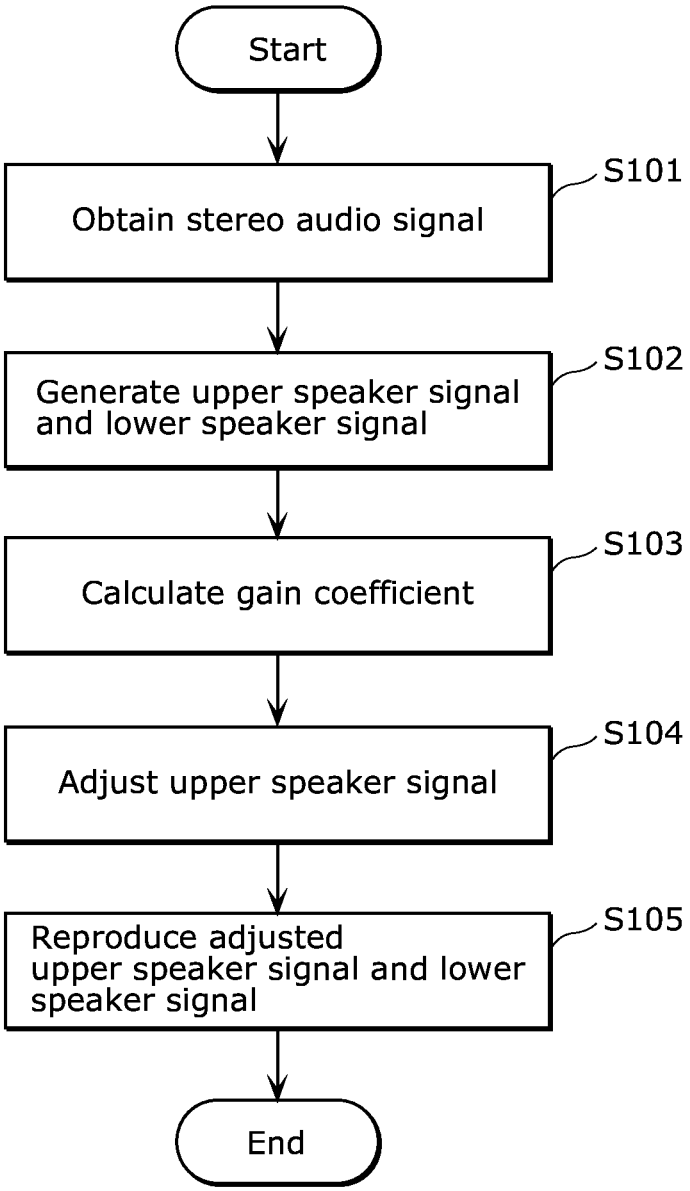
FIG. 5 is a flowchart of operations performed by the audio reproducing apparatus according to Embodiment 1.

First, a functional configuration and operations of an audio reproducing apparatus 10 according to Embodiment 1 will be described. FIG. 4 is a block diagram illustrating the functional configuration of the audio reproducing apparatus 10 according to Embodiment 1. FIG. 5 is a flowchart of the operations performed by the audio reproducing apparatus 10 according to Embodiment 1.

The audio reproducing apparatus 10 in FIG. 4 is an apparatus provided for the listening space in FIG. 2. The upper speaker 105 is disposed above the listener 201 (on the ceiling 207 of the room) in FIG. 2 in the following description. Furthermore, lower speakers 106 (an L channel speaker 106L and an R channel speaker 106R) are disposed below the upper speaker 105. The upper speaker 105 does not necessarily have to be disposed on the ceiling 207 as long as it is higher than the L channel speaker 106L and the R channel speaker 106R.

The audio reproducing apparatus 10 in FIG. 4 includes an obtainment unit 100, a control unit 107 (an audio signal generating unit 101, a signal correlation calculating unit 102, a gain coefficient calculating unit 103, and a gain adjustment unit 104), the upper speaker 105, and the lower speakers 106.

The obtainment unit 100 obtains a stereo audio signal 110 including an L channel signal and an R channel signal (S101 in FIG. 5). The obtainment unit 100 is specifically an input interface such as an audio input terminal (audio input connector).

The audio signal generating unit 101 generates an upper speaker signal 113 (a first audio signal) and a lower speaker signal 114 (a second audio signal) using the stereo audio signal 110 obtained by the obtainment unit 100 (S102 in FIG. 5). The upper speaker signal 113 is a signal for the upper speaker 105 disposed at an upper position in the listening space, whereas the lower speaker signal 114 is a signal for the lower speakers 106 disposed at a lower position in the listening space.

The audio signal generating unit 101 generates, specifically, a signal that complements the L channel signal and the R channel signal as the upper speaker signal 113. In other words, the upper speaker signal 113 is a signal for filling a gap in sound in a sound field formed by the sounds reproduced from the L channel signal and the R channel signal.

The audio signal generating unit 101 generates the upper speaker signal 113 by smoothly complementing the L channel signal and the R channel signal. For example, the audio signal generating unit 101 generates the upper speaker signal 113 by combining the L channel signal and the R channel signal, based on the following expression.

[Math 1]

$$Ce=mL+nR,\ (m+n=1.0) \qquad \text{(Expression 1)}$$

Here, Ce denotes the upper speaker signal 113. Furthermore, L denotes the L channel signal, and R denotes the R channel signal. Furthermore, m and n denote degrees of contribution to the L channel signal and the R channel signal, respectively. Embodiment 1 defines m+1=1.

In the Description, "combining the L channel signal and the R channel signal" equates to adding the L channel signal multiplied by a coefficient (real number other than 0) and the R channel signal multiplied by a coefficient (real number other than 0).

For example, the audio signal generating unit 101 generates the upper speaker signal 113 based on the following expression so that the sound reproduced from the upper speaker signal 113 is located between the L channel speaker 106L and the R channel speaker 106R.

[Math 2]

$$Ce=\tfrac{1}{2}(L+R) \qquad \text{4(Expression 2)}$$

In other words, the audio signal generating unit 101 generates the upper speaker signal 113 by adding the L channel signal multiplied by a positive coefficient and the R channel signal multiplied by a positive coefficient.

With generation of the upper speaker signal 113 by the audio signal generating unit 101 as described above, the audio reproducing apparatus 10 can three-dimensionally generate the sound field 205 to surround the listener 201. Accordingly, the listener 201 can be provided with, for example, a comfortable sound field surrounded by music.

On the other hand, the audio signal generating unit 101 outputs (generates) the L channel signal and the R channel signal included in the stereo audio signal 110 as the lower speaker signal 114. Specifically, the audio signal generating unit 101 generates the L channel signal as the lower speaker signal 114 for the L channel speaker 106L, and the R channel signal as the lower speaker signal 114 for the R channel speaker 106R.

The audio signal generating unit 101 may generate the L channel signal as the lower speaker signal 114 for one of the L channel speaker 106L and the R channel speaker 106R, and the R channel signal as the lower speaker signal 114 for the other of the L channel speaker 106L and the R channel speaker 106R.

The signal correlation calculating unit 102 calculates a signal correlation 111 between the L channel signal and the R channel signal that are included in the stereo audio signal 110. Then, the signal correlation calculating unit 102 outputs the calculated signal correlation 111 to the gain coefficient calculating unit 103.

In calculating the signal correlation 111, the signal correlation calculating unit 102 may use any method for calculating information indicating a correlation between the L channel signal and the R channel signal, for example, using a cross-correlation function.

The gain coefficient calculating unit 103 calculates a gain coefficient for adjusting a gain of the upper speaker signal 113, based on at least the signal correlation 111 and the lower speaker signal 114 (S103 in FIG. 5). In other words, the gain coefficient calculating unit 103 determines a gain coefficient according to a degree of correlation between the L channel signal and the R channel signal.

Hereinafter, a method for calculating a gain coefficient by the gain coefficient calculating unit 103 will be specifically described. The upper speaker signal 113 is generated based on Expression 2 above. Furthermore, in the following description of calculation of the gain coefficient, ECe denotes a sum of energy of the upper speaker signals 113, and Es denotes a sum of energy of the lower speaker signals 114.

Furthermore, a gain coefficient α is calculated (updated) per predetermined period (for example, 50 ms). In the following expressions, each of L and R is represented by a vector having elements whose number is equal to the number of samples of channel signals for a predetermined period. Here, each of the elements represents a sample value of a signal level.

The gain coefficient α is a coefficient for maintaining ECe and Es at a predetermined ratio k (a constant). The gain coefficient α, k, ECe, and Es have a relationship expressed by the following expression. The location of a sound field can be vertically shifted by changing the value of k. Specifically, the value of k is appropriately set according to a shape of a room and others.

[Math 3]

$$Es=k\cdot\alpha^2\cdot ECe \quad \text{(Expression 3)}$$

Here, ECe and Es are calculated by the following expressions.

[Math 4]

$$ECe=\tfrac{1}{4}(L^2+R^2+2(L\cdot R)) \quad \text{(Expression 4)}$$

[Math 5]

$$Es=(L^2+R^2) \quad \text{(Expression 5)}$$

Substituting Expressions 4 and 5 into Expression 3 yields the following Expression 6. By modifying Expression 6, the gain coefficient α is calculated as Expression 7.

[Math 6]

$$L^2+R^2=k\cdot\alpha^2\cdot\frac{1}{4}(L^2+R^2+2(L\cdot R)) \quad \text{(Expression 6)}$$

[Math 7]

$$\alpha=\frac{2}{\sqrt{k}}\sqrt{\frac{L^2+R^2}{L^2+R^2+2(L\cdot R)}} \quad \text{(Expression 7)}$$

In Expression 7, the terms of $L^2$ and $R^2$ are independent from the degree of correlation between the L channel signal and the R channel signal. However, the term of (L·R) varies in value according to the degree of correlation between the L channel signal and the R channel signal. In other words, the gain coefficient α is a parameter defined according to the degree of correlation between the L channel signal and the R channel signal. As described above, L and R are vectors, and the term of (L·R) is an inner product of L and R.

As such, the gain coefficient calculating unit 103 calculates the gain coefficient α (a gain coefficient 112) based on Expression 7 and the signal correlation 111. Then, the gain coefficient calculating unit 103 outputs the calculated gain coefficient 112 to the gain adjustment unit 104.

The gain adjustment unit 104 adjusts the upper speaker signal 113 using the gain coefficient 112 output from the gain coefficient calculating unit 103 (S104 in FIG. 5). Specifically, the gain adjustment unit 104 multiplies the upper speaker signal 113 by the gain coefficient 112 to output an adjusted upper speaker signal 115 to the upper speaker 105.

The gain coefficient calculating unit 103 calculates the gain coefficient 112 and the gain adjustment unit 104 adjusts the gain coefficient, at predetermined time intervals. In other words, the control unit 107 (the gain coefficient calculating unit 103 and the gain adjustment unit 104) updates the gain coefficient 112 at predetermined time intervals, and multiplies the upper speaker signal 113 by the updated gain coefficient 112.

Finally, the adjusted upper speaker signal 115 and the lower speaker signal 114 are reproduced (S105 in FIG. 5).

The upper speaker 105 is a speaker disposed above the listener 201. The upper speaker 105 reproduces the adjusted upper speaker signal 115 output from the gain adjustment unit 104.

The lower speakers 106 (the L channel speaker 106L and the R channel speaker 106R) are speakers disposed below the upper speaker 105. The lower speakers 106 reproduce the lower speaker signal 114 input from the audio signal generating unit 101 (S105 in FIG. 5).

The adjustment using the gain coefficient 112 can suppress variations in distribution of the sound field.

The upper speaker signal 113 is generated by adding the L channel signal multiplied by a coefficient and the R channel signal multiplied by a coefficient as expressed in Expressions 1 and 2. Thus, energy of the sound output from the upper speaker 105 fluctuates according to the degree of correlation between the L channel signal and the R channel signal, that is, a degree of the term of (L·R). Accordingly, a ratio between the energy of the sound output from the upper speaker 105 and energy of the sound output from the lower speakers 106 varies, and distribution of the sound field also varies.

Here, by adjusting the upper speaker signal 113 with the gain coefficient 112 corresponding to the degree of correlation in advance, the ratio between the energy of the sound output from the upper speaker 105 and the energy of the sound output from the lower speakers 106 can be approximated to a predetermined value, and variations in distribution of the sound field can be suppressed.

Figure 6:
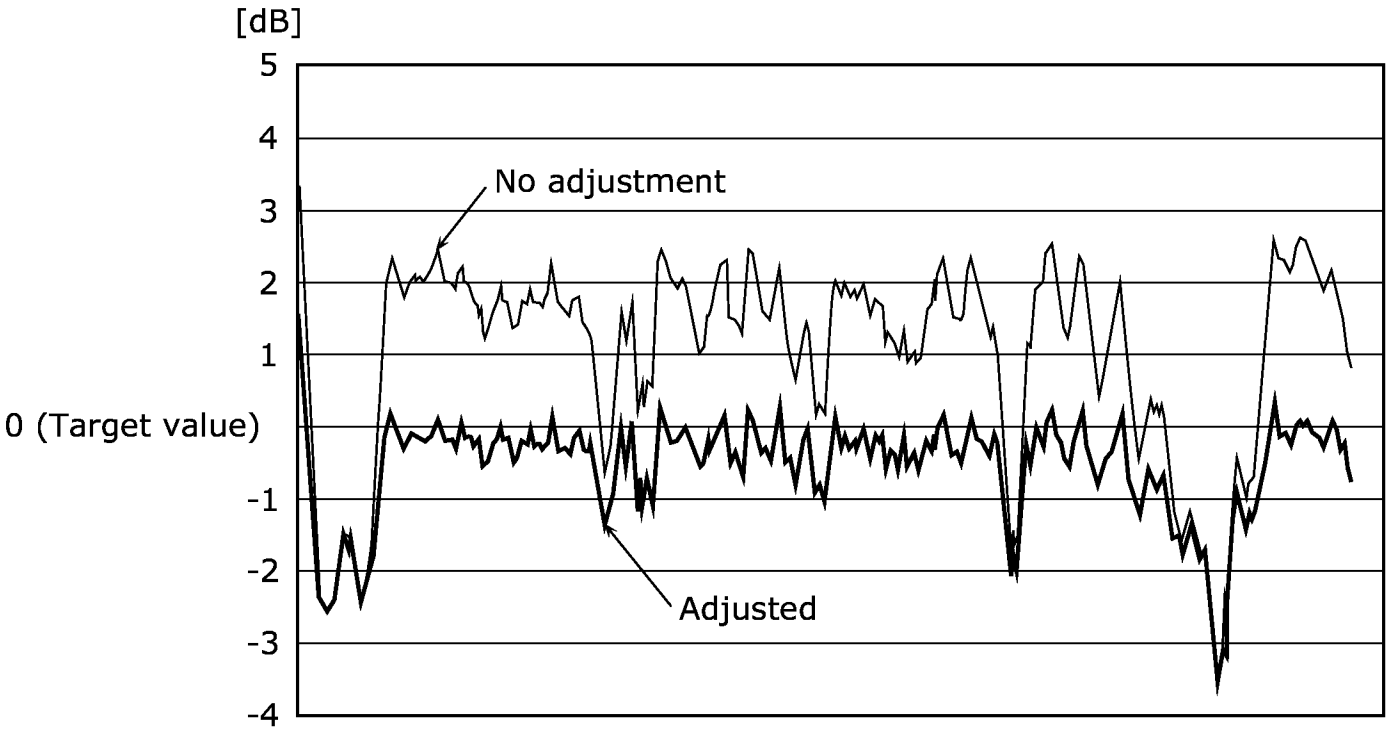
FIG. 6 illustrates an effect of suppressing change in distribution of a sound field by the audio reproducing apparatus according to Embodiment 1.

FIG. 6 illustrates the effect of suppressing variations in distribution of the sound field by the audio reproducing apparatus 10. The vertical axis in FIG. 6 represents the ratio between the energy of the sound output from the upper speaker 105 and the energy of the sound output from the lower speakers 106 in dB. In FIG. 6, 0 is a target value. The horizontal axis in FIG. 6 represents time.

The graph with the legend "No adjustment" (thin line) is a graph obtained when the adjustment using the gain coefficient 112 is not performed. The graph with the legend "Adjusted" (thick line) is a graph obtained when the adjustment using the gain coefficient 112 is performed.

In the graphs of FIG. 6, as the graphs in the vertical direction fluctuate a lot, distribution of the sound field varies at a higher degree. As illustrated in FIG. 6, the audio reproducing apparatus 10 performs the adjustment using the gain coefficient, so that the ratio between the energy of the sound output from the upper speaker 105 and the energy of the sound output from the lower speakers 106 approximates to the target value and fluctuation of the graph in the vertical direction is suppressed. In other words, FIG. 6 shows that the adjustment using the gain coefficient 112 by the audio reproducing apparatus 10 enables the sound field to be set closer to a desired position and variations in distribution of the sound field to be suppressed.

In a portion where the graph with the legend "No adjustment" and the graph with the legend "Adjusted" overlap one another, that is, a portion where the graph with the legend "Adjusted" greatly deviates from the target value, the sound to be output is so minute that the adjustment using the gain coefficient 112 is not performed. This is because when the sound to be output is minute, the adjustment using the gain coefficient 112 may result in adverse effect.

As described above, the audio reproducing apparatus 10 according to Embodiment 1 can suppress variations in distribution of the diffuse sound field, set the diffuse sound field closer to a desired position, and reduce uncomfortable feeling of the listener.

According to Embodiment 1, the gain adjustment unit 104 multiplies the upper speaker signal 113 by the gain coefficient 112. Here, the audio reproducing apparatus 10 intends to maintain as constant as possible a ratio between the energy of the sound output from the upper speaker 105 and the energy of the sound output from the lower speakers 106.

Thus, the gain coefficient calculating unit 103 may calculate the gain coefficient 112 for the lower speaker signal 114, and the gain adjustment unit 104 may adjust the lower speaker signal 114 by multiplying the lower speaker signal 114 by the calculated gain coefficient 112.

Furthermore, the gain coefficient calculating unit 103 may calculate the gain coefficient 112 for each of the upper speaker signal 113 and the lower speaker signal 114, and the gain adjustment unit 104 may adjust both the upper speaker signal 113 and the lower speaker signal 114.

The number of the upper speakers 105 and the number of the lower speakers 106 are not limited by the configuration in FIGS. 1 and 2. For example, the number of the upper speakers 105 and the number of the lower speakers 106 may be more than one.

In such a case, the gain coefficient 112 is calculated by at least dividing one of a sum of energy of the upper speaker signals 113 and a sum of energy of the lower speaker signals 114 by the other, and taking the square root of a resulting value from the dividing. Then, the calculated gain coefficient 112 is multiplied by, for example, each of the upper speaker signals 113 (or each of the lower speaker signals 114).

The "degree of correlation" in the Description will be elaborated on hereinafter. A higher degree of correlation between the L channel signal and the R channel signal indicates existence of a large sound image (virtual sound source) at an intermediate point between the L channel speaker and the R channel speaker.

Conversely, a lower degree of correlation between the L channel signal and the R channel signal indicates existence of a small sound image (virtual sound source) at an intermediate point between the L channel speaker and the R channel speaker, or no existence of a sound image.

Embodiment 2

According to Embodiment 1, the audio signal generating unit 101 generates the L channel signal and the R channel signal included in the stereo audio signal 110 as the lower speaker signal 114.

Here, the audio signal generating unit 101 may generate a signal obtained by combining the L channel signal and the R channel signal as the lower speaker signal 114. As such, the audio reproducing apparatus 10 has only to generate at least one of the upper speaker signal 113 and the lower speaker signal 114, by adding the L channel signal multiplied by a coefficient and the R channel signal multiplied by a coefficient.

Figure 7:
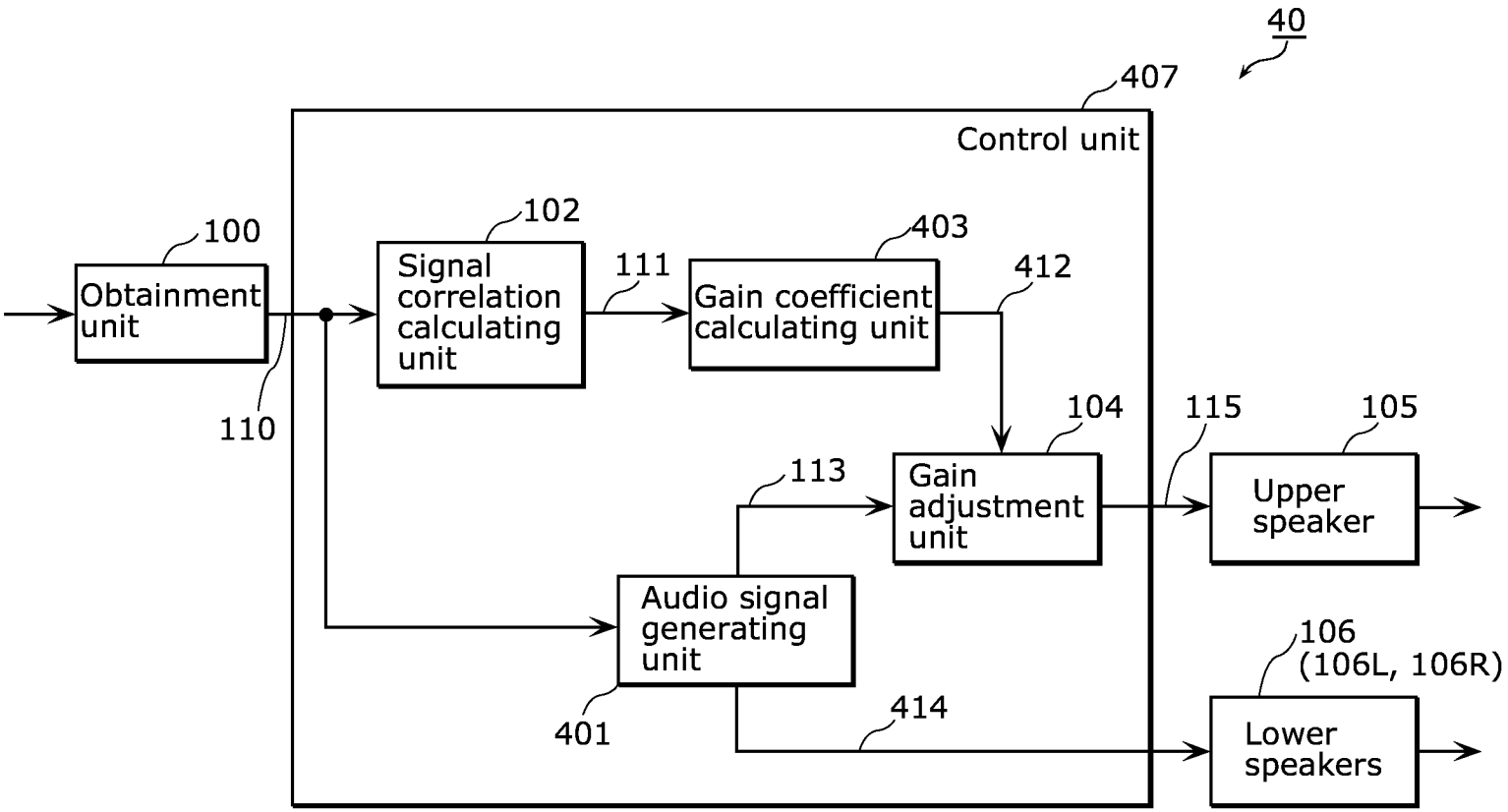
FIG. 7 is a block diagram illustrating a functional configuration of an audio reproducing apparatus according to Embodiment 2.

Embodiment 2 will describe an audio reproducing apparatus 40 that generates a signal obtained by combining the L channel signal and the R channel signal as the lower speaker signal 114. FIG. 7 is a block diagram illustrating a functional configuration of the audio reproducing apparatus 40 according to Embodiment 2.

The audio reproducing apparatus 40 in FIG. 7 differs from the audio reproducing apparatus 10 by an audio signal generating unit 401 and a gain coefficient calculating unit 403 in replacement of the audio signal generating unit 101 and the gain coefficient calculating unit 103. In other words, the audio reproducing apparatus 40 differs from the audio reproducing apparatus 10 by operations of the audio signal generating unit 401 and the gain coefficient calculating unit 403 in a control unit 407.

The operations of the audio signal generating unit 401 and the gain coefficient calculating unit 403 will be hereinafter described in detail. The detailed description of the constituent elements substantially identical to those of Embodiment 1 will be omitted.

Furthermore, the number of the upper speakers 105 and the number of the lower speakers 106 are any as according to Embodiment 1, and one upper speaker 105 and two lower speakers 106 are used in Embodiment 2.

The audio signal generating unit 401 generates lower speaker signals 414 obtained by combining (mixing) the L channel signal and the R channel signal included in the stereo audio signal 110 at a predetermined ratio. Then, the audio signal generating unit 401 outputs the lower speaker signals 414 to the lower speakers 106.

Here, a signal L' for a new L channel speaker 106L and a signal R' for a new R channel speaker 106R that are the lower speaker signals 414 generated by the audio signal generating unit 401 are calculated by the following expressions.

[Math 8]

$$L' = \tfrac{1}{2}(L - bR)$$

$$R' = \tfrac{1}{2}(R - bL) \qquad \text{(Expression 8)}$$

Here, b denotes a constant (b>0). As such, the spatial impression of the sound field can be enhanced by mixing each of the channel signals included in the stereo audio signal 110 and a reverse phase signal that is a signal obtained by multiplying a signal paired with the channel signal by a negative gain (coefficient).

Furthermore, the audio signal generating unit 401 generates the upper speaker signal 113 based on Expression 2, and outputs it to the gain adjustment unit 104 as according to Embodiment 1.

The gain coefficient calculating unit 403 calculates a gain coefficient for adjusting the gain of the upper speaker signal 113, based on at least the signal correlation 111 and the lower speaker signals 414.

A method for calculating the gain coefficient by the gain coefficient calculating unit 403 will be specifically described hereinafter. The upper speaker signal 113 is generated based on Expression 2 above. Furthermore, the lower speaker signals 414 (L' and R') are generated based on Expression 8 above.

A sum of energy of the lower speaker signals 414 or Es' will be expressed by the following expression.

[Math 9]

$$\begin{aligned} Es' &= (L')^2 + (R')^2 \qquad \text{(Expression 9)} \\ &= \frac{1}{4}((1 + b^2)(L^2 + R^2) - 4b(L \cdot R)) \end{aligned}$$

Substituting Expressions 4 and 9 into Expression 10 yields the following Expression 11. By modifying Expression 11, the gain coefficient α (412) is calculated as Expression 12.

[Math 10]

$$Es' = k \cdot \alpha^2 \cdot ECe \qquad \text{(Expression 10)}$$

[Math 11]

$$\frac{1}{4}((1 + b^2)(L^2 + R^2) - 4b(L \cdot R)) = k \cdot \alpha^2 \cdot \frac{1}{4}(L^2 + R^2 + 2(L \cdot R)) \qquad \text{(Expression 11)}$$

[Math 12]

$$\alpha = \frac{1}{\sqrt{k}} \sqrt{\frac{(1 + b^2)(L^2 + R^2) - 4b(L \cdot R)}{L^2 + R^2 + 2(L \cdot R)}} \qquad \text{(Expression 12)}$$

The gain adjustment unit 104 adjusts the upper speaker signal 113 using the gain coefficient 412 generated by and output from the gain coefficient calculating unit 403. Specifically, the gain adjustment unit 104 multiplies the upper speaker signal 113 by the gain coefficient 412 to output the adjusted upper speaker signal 115 to the upper speaker 105.

As described above, the audio reproducing apparatus 40 can calculate the appropriate gain coefficient 412 and suppress variations in distribution of the sound field when generating a signal obtained by combining the L channel signal and the R channel signal as the lower speaker signal 114.

Other Embodiments

Embodiments 1 and 2 are hereinbefore described as technical exemplification of the present application. However, the techniques according to the present disclosure may be, but not limited to, applicable to embodiments to which various changes, replacement, addition, and omission are appropriately performed. Furthermore, combinations of the constituent elements described in Embodiments 1 and 2 allow implementation of new embodiments.

For example, the value of k in Expressions 7 and 12 may be set by the listener 201. Here, the audio reproducing apparatus further includes an input receiving unit that receives the value of k from the listener 201, and the gain coefficient α is changed according to the value of k received by the input receiving unit. Accordingly, the listener 201 can adjust a location of the sound field in the vertical direction to a desired position.

Furthermore, the general or specific aspects of the techniques according to the present disclosure may be implemented by a system, a method, an integrated circuit, a computer program, or a computer-readable recording medium, such as a CD-ROM, or by an arbitrary combination of the system, the method, the integrated circuit, the computer program, and the recording medium.

Each of the constituent elements may be implemented by dedicated hardware or by executing a software program appropriate for the constituent element. Each of the constituent elements may be implemented by a program executing unit, such as a central processing unit (CPU) and a processor, through reading and executing the software program recorded on a recording medium, such as a hard disk or a semiconductor memory. Specifically, the control unit in Embodiments 1 and 2 may be implemented as a digital signal processor (DSP) and one of the functions of the DSP.

SUMMARY

Embodiments hereinbefore are described as technical exemplification of the present disclosure. Thus, the attached drawings and the detailed description are provided.

The constituent elements described in the attached drawings and the detailed description may include both constituent elements essential for solving the problems and constituent elements that exemplify the techniques but are not essential for solving the problems. Thus, the attached drawings and the detailed description may include non-essential constituent elements.

Furthermore, since the embodiments herein exemplify the techniques of the present disclosure, various changes, replacement, addition, and omission may be performed within the scope of the claims or the equivalents.

INDUSTRIAL APPLICABILITY

The present disclosure is applicable to audio reproducing apparatuses in a sound playback environment in which speakers are disposed to cause variations in distribution of the sound field. Specifically, the present disclosure is applicable to AV amplifiers.

REFERENCE SIGNS LIST

10, 40 Audio reproducing apparatus
100 Obtainment unit
101, 401 Audio signal generating unit
102 Signal correlation calculating unit
103, 403 Gain coefficient calculating unit
104 Gain adjustment unit
105 Upper speaker
106, 106*a*, 106*b*, 106*c*, 106*d* Lower speaker
106L L channel speaker
106R R channel speaker
107, 407 Control unit
110 Stereo audio signal
111 Signal correlation
112, 412 Gain coefficient
113 Upper speaker signal
114, 414 Lower speaker signal
115 Adjusted upper speaker signal
201, 201*a*, 201*b* Listener
205, 301, 302, 303 Sound field
206 Floor surface
207 Ceiling

The invention claimed is:

1. An audio reproducing apparatus, comprising:

an obtainment unit configured to obtain a stereo audio signal including an L channel signal and an R channel signal; and a control unit configured to (i) generate a first audio signal for a speaker disposed at an upper position in a listening space and a second audio signal for a speaker disposed at a lower position in the listening space, using the L channel signal and the R channel signal and (ii) determine a gain coefficient based on the L channel signal, the R channel signal, and a degree of correlation between the L channel signal and the R channel signal and multiply by the determined gain coefficient at least one of the first audio signal and the second audio signal, to approximate a ratio between energy of sound reproduced from the first audio signal and energy of sound reproduced from the second audio signal to a predetermined value, wherein the control unit is configured to generate at least one of the first audio signal and the second audio signal by combining the L channel signal and the R channel signal.

2. The audio reproducing apparatus according to claim 1, wherein the control unit is configured to determine the gain coefficient by at least dividing one of a sum of energy of the first audio signal and a sum of energy of the second audio signal by the other one of the sum of energy of the first audio signal and the sum of energy of the second audio signal, and taking a square root of a value resulting from the dividing.

3. The audio reproducing apparatus according to claim 1, wherein the control unit is configured to update the gain coefficient at predetermined time intervals, and multiply at least one of the first audio signal and the second audio signal by the updated gain coefficient.

4. The audio reproducing apparatus according to claim 1, wherein the control unit is configured to:

when generating the first audio signal, multiply the L channel signal by a positive coefficient and the R channel signal by a positive coefficient, and add, in the combining, the L channel signal and the R channel signal; and generate the L channel signal and the R channel signal as two second audio signals including the second audio signal.

5. The audio reproducing apparatus according to claim 1, wherein the control unit is configured to:

when generating the first audio signal, multiply the L channel signal by a positive coefficient and the R channel signal by a positive coefficient, and add, in the combining, the L channel signal and the R channel signal; and when generating two second audio signals including the second audio signal, (i) multiply the L channel signal by a positive coefficient and the R channel signal by a negative coefficient and add, in the combining, the L channel signal and the R channel signal, and (ii) multiply the R channel signal by a positive coefficient and the L channel signal by a negative coefficient and add, in the combining, the L channel signal and the R channel signal.

6. An audio reproducing method, comprising:

obtaining a stereo audio signal including an L channel signal and an R channel signal;

generating a first audio signal for a speaker disposed at an upper position in a listening space and a second audio signal for a speaker disposed at a lower position in the listening space, using the L channel signal and the R channel signal;

determining a gain coefficient based on the L channel signal, the R channel signal, and a degree of correlation between the L channel signal and the R channel signal; and multiplying by the determined gain coefficient at least one of the first audio signal and the second audio signal, to approximate a ratio between energy of sound reproduced from the first audio signal and energy of sound reproduced from the second audio signal to a predetermined value, wherein in the multiplying, at least one of the first audio signal and the second audio signal is generated by combining the L channel signal and the R channel signal.

* * * * *